US011804201B2

(12) United States Patent
Ueno

(10) Patent No.: US 11,804,201 B2
(45) Date of Patent: Oct. 31, 2023

(54) TUNING DEVICE AND TUNING METHOD

(71) Applicant: Roland Corporation, Shizuoka (JP)

(72) Inventor: Masato Ueno, Shizuoka (JP)

(73) Assignee: Roland Corporation, Shizuoka (JP)

( * ) Notice: Subject to any disclaimer, the term of this patent is extended or adjusted under 35 U.S.C. 154(b) by 31 days.

(21) Appl. No.: 17/605,004

(22) PCT Filed: Apr. 26, 2019

(86) PCT No.: PCT/JP2019/018058

§ 371 (c)(1),
(2) Date: Oct. 20, 2021

(87) PCT Pub. No.: WO2020/217489

PCT Pub. Date: Oct. 29, 2020

(65) Prior Publication Data

US 2022/0230607 A1 Jul. 21, 2022

(51) Int. Cl.
*G10H 1/44* (2006.01)
*G10G 7/02* (2006.01)

(52) U.S. Cl.
CPC ..... *G10G 7/02* (2013.01); *G10H 1/44* (2013.01)

(58) Field of Classification Search
CPC .... G10H 1/44; G10H 2210/066; G10H 3/125; G10H 1/0008; G10H 1/0091; G10H 2210/031; G10H 2210/081; G10H 1/02; G10H 1/46; G10H 2220/021
See application file for complete search history.

(56) References Cited

U.S. PATENT DOCUMENTS 4,122,751 A 10/1978 Calvin
4,281,577 A * 8/1981 Middleton ..... G10H 1/44 984/260
2012/0240749 A1 9/2012 Bjornson
2014/0060289 A1* 3/2014 Hirshberg ..... G10H 5/02 84/654
2016/0372097 A1* 12/2016 Rogers ..... G10H 1/44
(Continued)

FOREIGN PATENT DOCUMENTS

CN 105845113 A * 8/2016 ..... G10G 7/02
JP S56162081 12/1981
(Continued)

OTHER PUBLICATIONS

"International Search Report (Form PCT/ISA/210) of PCT/JP2019/018058", dated Jun. 25, 2019, with English translation thereof, pp. 1-6.
(Continued)

*Primary Examiner* — Marlon T Fletcher
(74) *Attorney, Agent, or Firm* — JCIPRNET

(57) ABSTRACT

Provided is a device for reporting a tuning status by sound on the basis of an audio signal acquired. The device includes: a signal acquisition means for acquiring the audio signal; a comparison means for comparing the frequency of the audio signal with a reference frequency corresponding to the audio signal; and a generation means for generating a first sound signal when the frequency of the audio signal is lower than the reference frequency and generating a second sound signal different from the first sound signal when the frequency of the audio signal is higher than the reference frequency.

14 Claims, 10 Drawing Sheets

(56) References Cited

U.S. PATENT DOCUMENTS

| | | | | |
|---|---|---|---|---|
| 2017/0090860 | A1* | 3/2017 | Gehring | G06F 3/165 |
| 2017/0092245 | A1* | 3/2017 | Kozielski | G10H 1/383 |
| 2017/0092246 | A1* | 3/2017 | Manjarrez | G11B 20/10527 |
| 2019/0287505 | A1* | 9/2019 | Jeon | G10H 3/143 |

FOREIGN PATENT DOCUMENTS

| | | | | | |
|---|---|---|---|---|---|
| JP | S6365097 | | | 4/1988 | |
| JP | S6389897 | | | 4/1988 | |
| JP | 2000046407 | | | 2/2000 | |
| JP | 2004053779 | | | 2/2004 | |
| JP | 2005017995 | | | 1/2005 | |
| JP | 2005091485 | | | 4/2005 | |
| JP | 2006220882 | | | 8/2006 | |
| JP | 2007094220 | | | 4/2007 | |
| JP | 2009086443 | | | 4/2009 | |
| JP | 2019028407 | | | 2/2019 | |
| KR | 20090130630 | A | * | 6/2008 | |
| KR | 20130051386 | | | 5/2013 | |
| WO | WO-2015166981 | | * | 4/2015 | |
| WO | WO-2015166981 | A1 | * | 11/2015 | G10G 7/02 |
| WO | WO-2020217489 | A1 | * | 10/2020 | G10G 7/02 |

OTHER PUBLICATIONS

"Search Report of Europe Counterpart Application", dated Feb. 17, 2023, pp. 1-8.

* cited by examiner

| PITCH | FREQUENCY | RANGE |
|---|---|---|
| C4 | 261.6 | 254～277Hz |
| D4 | 293.6 | 277～311Hz |
| E4 | 329.6 | 311～339Hz |
| F4 | 349.2 | 339～370Hz |
| G4 | 391.9 | 370～416Hz |
| A4 | 440.0 | 416～466Hz |
| B4 | 493.8 | 466～508Hz |

FIG. 8

TUNING DEVICE AND TUNING METHOD

CROSS-REFERENCE TO RELATED APPLICATION

This application is a 371 application of the International PCT application serial no. PCT/JP2019/018058, filed on Apr. 26, 2019. The entirety of the above-mentioned patent application is hereby incorporated by reference herein and made a part of this specification.

TECHNICAL FIELD

The present invention relates to a technique of tuning a musical instrument.

BACKGROUND ART

In the musical instrument field, there is a device that performs tuning on the basis of a musical sound signal output from a musical instrument. For example, Patent Literatures 1 and 2 disclose a device that visually displays to what extent a frequency of sound output from a target musical instrument deviates relative to a frequency of a reference sound.

CITATION LIST

Patent Literature

[Patent Literature 1]
Japanese Patent Laid-Open No. 2009-86443
[Patent Literature 2]
Japanese Patent Laid-Open No. 2004-53779

SUMMARY

Technical Problem

According to the invention disclosed in Patent Literatures 1 and 2, a tuning status of an electronic musical instrument can be intuitively understood. On the other hand, in this invention, since a status is reported by using a light emitting element or a liquid crystal screen, an operator needs to always pay attention to the device during tuning work in order to ascertain a hierarchical pitch relationship between a sound output from a musical instrument and a reference sound. That is, there is a problem in that usability is reduced.

The present invention has been made in view of this problem, and an objective thereof is to provide a technique for intuitively reporting a difference between a pitch of a sound output from a musical instrument and a pitch of a reference sound.

Solution to Problem

According to the present invention, there is provided a tuning device including a signal acquisition means for acquiring an audio signal, a comparison means for comparing a frequency of the audio signal with a reference frequency corresponding to the audio signal, and a generation means for generating a first sound signal in a case where the frequency of the audio signal is lower than the reference frequency and generating a second sound signal different from the first sound signal in a case where the frequency of the audio signal is higher than the reference frequency.

The tuning device according to the present invention determines a hierarchical relationship between a frequency of an audio signal (for example, a musical sound signal acquired from an electronic musical instrument) and a reference frequency corresponding to the audio signal, and changes a sound signal to be generated on the basis of the hierarchical relationship.

According to this configuration, since it is possible to notify an operator of the hierarchical relationship between the frequency of the audio signal and the reference frequency only by sound, it is not necessary to always pay attention to the device, and thus usability can be improved.

In the present specification, the frequency of the audio signal is a frequency corresponding to a sound (for example, representing a sound) included in the audio signal, and is a frequency obtained by evaluating the audio signal according to any evaluation method. Therefore, the audio signal does not necessarily have to include only a single frequency component.

The first and second sound signals may be sound signals generated in a first cycle, and the first cycle may be a value correlated with a difference between the frequency of the audio signal and the reference frequency.

According to this configuration, in addition to a hierarchical relationship between frequencies, it is possible to report by sound how wide a difference between the frequencies is (how much the deviation width is).

In a case where the signal acquisition means has detected rising of the audio signal, the generation means may reset counting of the first cycle and immediately start to generate the first sound signal or the second sound signal.

For example, in a case where the audio signal is a musical sound signal output from an electronic musical instrument, the first cycle is reset and a sound signal is immediately generated when the operator hits a key or performs picking, and thus it is possible to transfer the current status to an operator more quickly. A rising timing of the audio signal may be, for example, a timing at which a level of the audio signal exceeds a predetermined value.

The first and second sound signals may be a combination of two or more sounds having different pitches, and the pitches may have opposite combinations in the first sound signal and the second sound signal.

For example, a combination of sounds having different pitches such as "high to low" and "low to high" is provided, and thus it is possible to intuitively report whether the frequency of the audio signal is lower or higher than the reference frequency.

Each of the sounds having different pitches does not necessarily have to be a single sound, and may change smoothly.

For example, the first and second sound signals may be sweep sounds in which two or more sounds having different pitches are continuously connected to each other, and are preferably exponential chirp signals. In this case, a pitch changes exponentially, and thus it is possible to report a vertical direction in an easy-to-understand manner.

In a case where the frequency of the audio signal is substantially the same as the reference frequency, the generation means may generate a third sound signal different from the first and second sound signals.

According to this configuration, it is possible to notify an operator by sound that a pitch has reached an ideal state.

The tuning device may further include an effect adding means for adding a predetermined effect to the audio signal, and the generation means may mix the audio signal to which an effect has been added with the first sound signal or the second sound signal.

The audio signal for reporting a tuning status and the audio signal to which a predetermined effect has been added are mixed, and thus an operator can understand a tuning target sound.

According to another aspect of the present invention, there is provided a tuning device including a signal acquisition means for acquiring an audio signal, a comparison means for comparing a frequency of the audio signal with a reference frequency corresponding to the audio signal, and a generation means for generating a sound signal in a first cycle in a case where the frequency of the audio signal is not substantially the same as the reference frequency, in which the first cycle is a value correlated with a difference between the frequency of the audio signal and the reference frequency.

As described above, the present invention may also be specified as a device for reporting the magnitude of a frequency deviation width by sound.

The signal acquisition means may acquire the audio signal from a musical instrument that is capable of continuously adjusting a pitch according to an amount of tuning operation.

The present invention may be specified as a tuning device including at least some of the above means. The present invention may also be specified as a method performed by the tuning device. The present invention may also be specified as a program for executing the method. The above processes or means may be freely combined and implemented as long as there are no technical contradictions therebetween.

BRIEF DESCRIPTION OF THE DRAWINGS

FIG. 8 illustrates an example of a table for specifying a pitch from a frequency.

DESCRIPTION OF EMBODIMENTS

An electronic musical instrument system according to the present embodiment is configured to include a transmitter 10 that wirelessly transmits a sound signal output from an electronic musical instrument and a sound output device 20 that receives and amplifies the wirelessly transmitted sound signal and outputs an amplified result.

Figure 1:
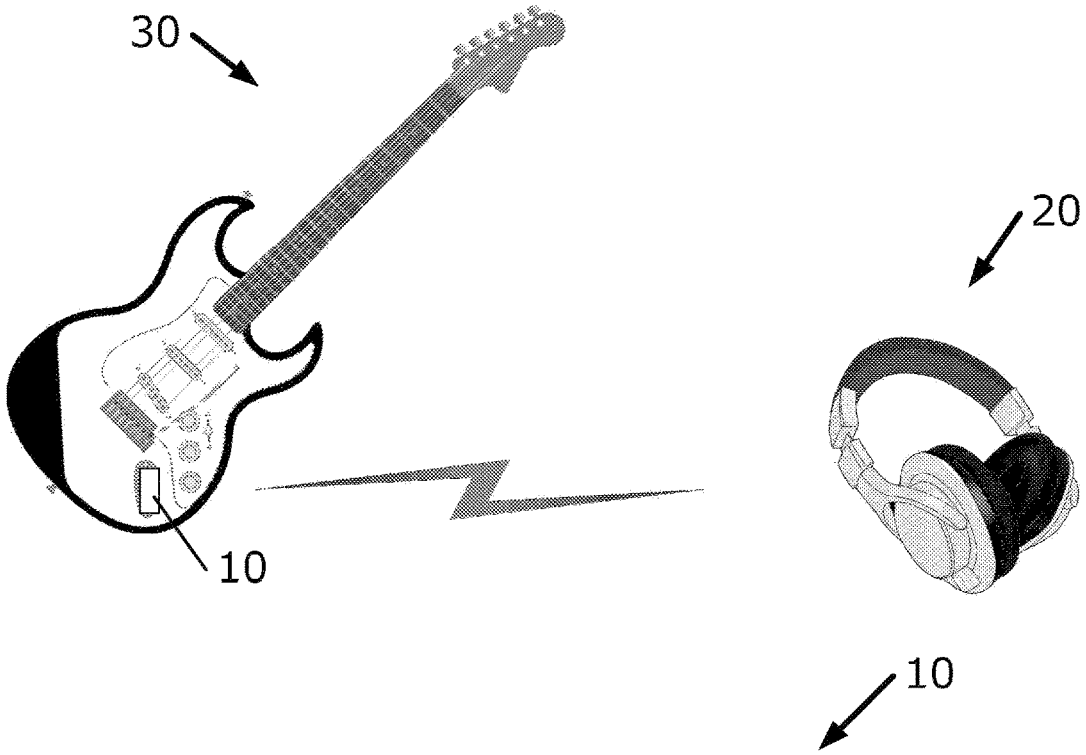
FIG. 1 is a configuration diagram of an electronic musical instrument system according to an embodiment.

FIG. 1 is a configuration diagram of the overall electronic musical instrument system according to the present embodiment.

Figure 2:
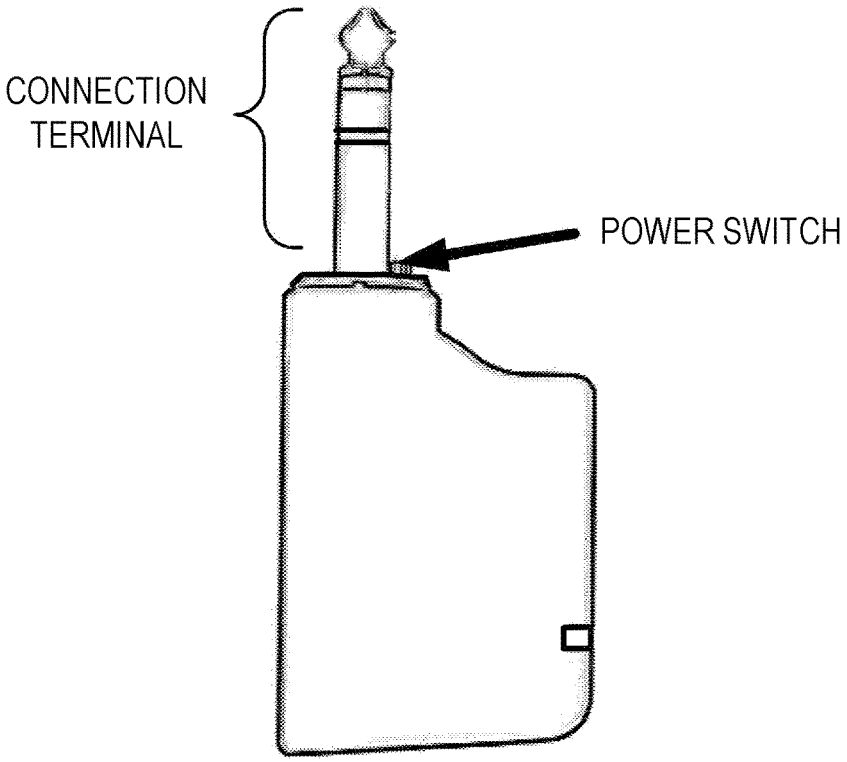
FIG. 2 is an appearance diagram of a transmitter.

The transmitter 10 is a portable device that is connected to a portable electronic musical instrument (an electronic guitar 30 in the present embodiment) having a performance operating device and wirelessly transmits a sound signal output from the electronic musical instrument. FIG. 2 is a diagram illustrating an appearance of the transmitter 10. As illustrated, the transmitter 10 may be connected to the electronic musical instrument via a phone plug having a three-pole connection terminal. When the transmitter 10 is inserted into a sound output terminal (phone jack) of the electronic musical instrument, a physical switch (power switch) is turned on, and the transmitter 10 acquires a sound signal from the electronic musical instrument, and wirelessly transmits the sound signal.

The electronic guitar 30 has a plurality of strings and a pickup that detects vibrations of the strings, detects the vibrations of the strings with the pickup, converts the vibrations into an electrical signal (sound signal), and outputs the signal. The electronic guitar 30 outputs the sound signal to the transmitter 10 via the phone jack. The output sound signal is modulated and wirelessly transmitted by the transmitter 10 to be received and demodulated by the sound output device 20 that is a headphone device, and is output.

Figure 3:
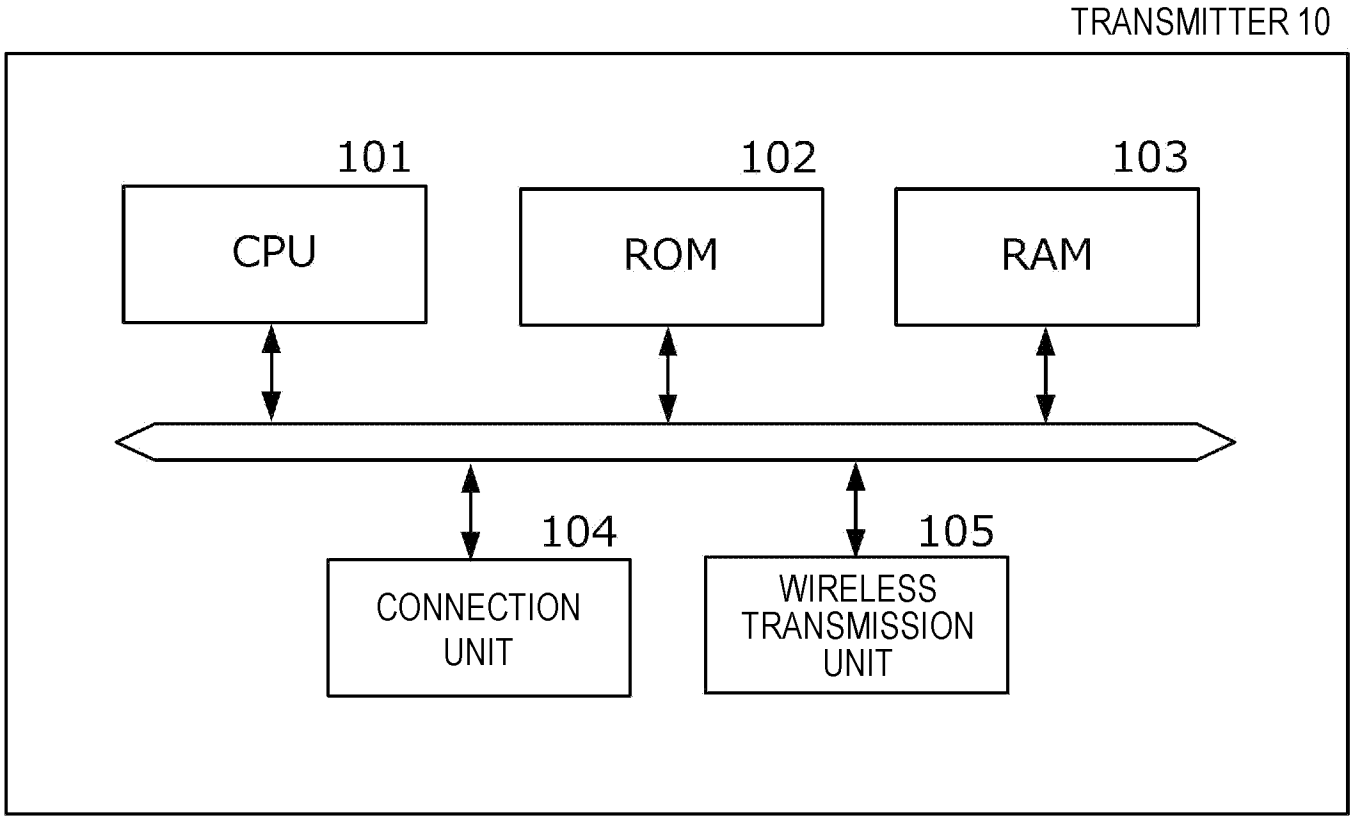
FIG. 3 is a hardware configuration diagram of the transmitter.

With reference to FIG. 3, a hardware configuration of the transmitter 10 will be described.

The transmitter 10 is configured to include a central processing unit (CPU) 101, a ROM 102, a RAM 103, a connection unit 104, and a wireless transmission unit 105. These means are driven by power supplied from a rechargeable type battery (not illustrated).

The CPU 101 is a calculation device that manages control performed by the transmitter 10.

The ROM 102 is a rewritable nonvolatile memory. The ROM 102 stores a control program executed by the CPU 101 and data (for example, a frequency used for transmitting a musical sound signal) used by the control program.

The RAM 103 is a memory to which the control program executed by the CPU 101 and the data used by the control program are loaded. The program stored in the ROM 102 is loaded to the RAM 103 and executed by the CPU 101 to perform processes described below.

The configuration illustrated in FIG. 3 is only an example, and all or some of the illustrated functions may be executed by using a dedicated circuit. The program may be stored or executed through a combination of a main storage device and an auxiliary storage device other than those illustrated.

The connection unit 104 is an interface (for example, a two-pole or three-pole phone plug) for physically connecting the transmitter 10 to the electronic guitar 30. The connection unit 104 has the connection terminal illustrated in FIG. 2, and is configured to be able to acquire a sound signal from the electronic guitar 30 when connected to the electronic guitar 30.

The power switch is disposed near the connection terminal of the connection unit 104, and the power switch is pressed by inserting the plug.

The wireless transmission unit 105 is a wireless communication interface that wirelessly transmits signals. In the present embodiment, the wireless transmission unit 105 transmits a sound signal output from the electronic guitar 30 to the sound output device 20.

The respective means are communicatively connected to each other via a bus.

Next, a hardware configuration of the sound output device 20 will be described with reference to FIG. 4.

The sound output device 20 is a headphone type device that amplifies and outputs a sound signal transmitted wirelessly from the transmitter 10. The sound output device 20 has (1) a function of performing a predetermined process (such as adding a sound effect) to the received sound signal, amplifying the sound signal, and outputting an amplified result, and (2) a function of tuning an electronic musical instrument on the basis of the received sound signal.

The two functions may be switched between by an operation performed by an operator.

The sound output device 20 is configured to include a wireless reception unit 201, a DSP 202, a ROM 203, a RAM 204, an amplifier 205, and a speaker 206. These means are driven by power supplied by a rechargeable type battery.

The wireless reception unit 201 is a wireless communication interface that receives a signal transmitted from the transmitter 10. In the present embodiment, the wireless reception unit 201 is wirelessly connected to the wireless transmission unit 105 of the transmitter 10, and receives a sound signal output from the electronic guitar 30.

The DSP 202 is a microprocessor specialized in digital signal processing. In the present embodiment, the DSP 202 performs processing specialized for processing an audio signal. Specifically, a signal acquired via the wireless reception unit 201 is decoded to acquire a sound signal, and an effect is added to the sound signal as necessary. The sound signal output from the DSP 202 is converted into an analog signal that is then amplified by the amplifier 205, and then the analog signal is output from the speaker 206.

The DSP 202 is configured to be able to execute a tuning process described in the present specification. A specific process will be described later.

The ROM 203 is a rewritable nonvolatile memory. The ROM 203 stores a control program executed by the DSP 202 and data used by the control program. The data stored in the ROM 203 may include, for example, a frequency or a channel list when the sound output device 20 and the transmitter 10 perform wireless communication. The data may also include information required for tuning (for example, information regarding a reference frequency (that will be described later with reference to FIG. 7)).

The RAM 204 is a memory to which the control program executed by the DSP 202 and the data used by the control program are loaded. The program stored in the ROM 203 is loaded to the RAM 204 and executed by the DSP 202 to perform processes described below.

Figure 4:
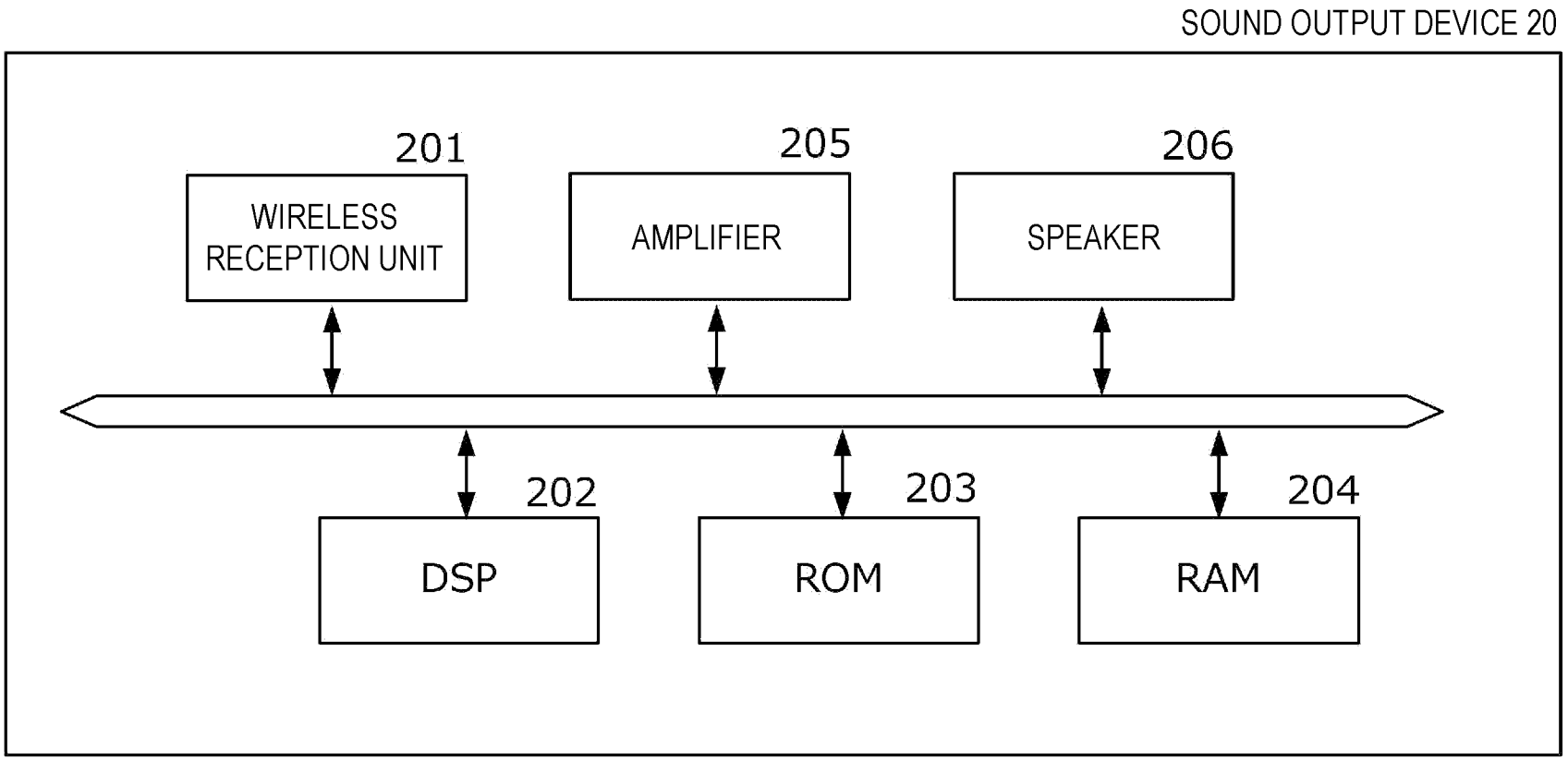
FIG. 4 is a hardware configuration diagram of a sound output device.

The configuration illustrated in FIG. 4 is only an example, and all or some of the illustrated functions may be executed by using a dedicated circuit. The program may be stored or executed through a combination of a main storage device and an auxiliary storage device other than illustrated.

Figure 5:
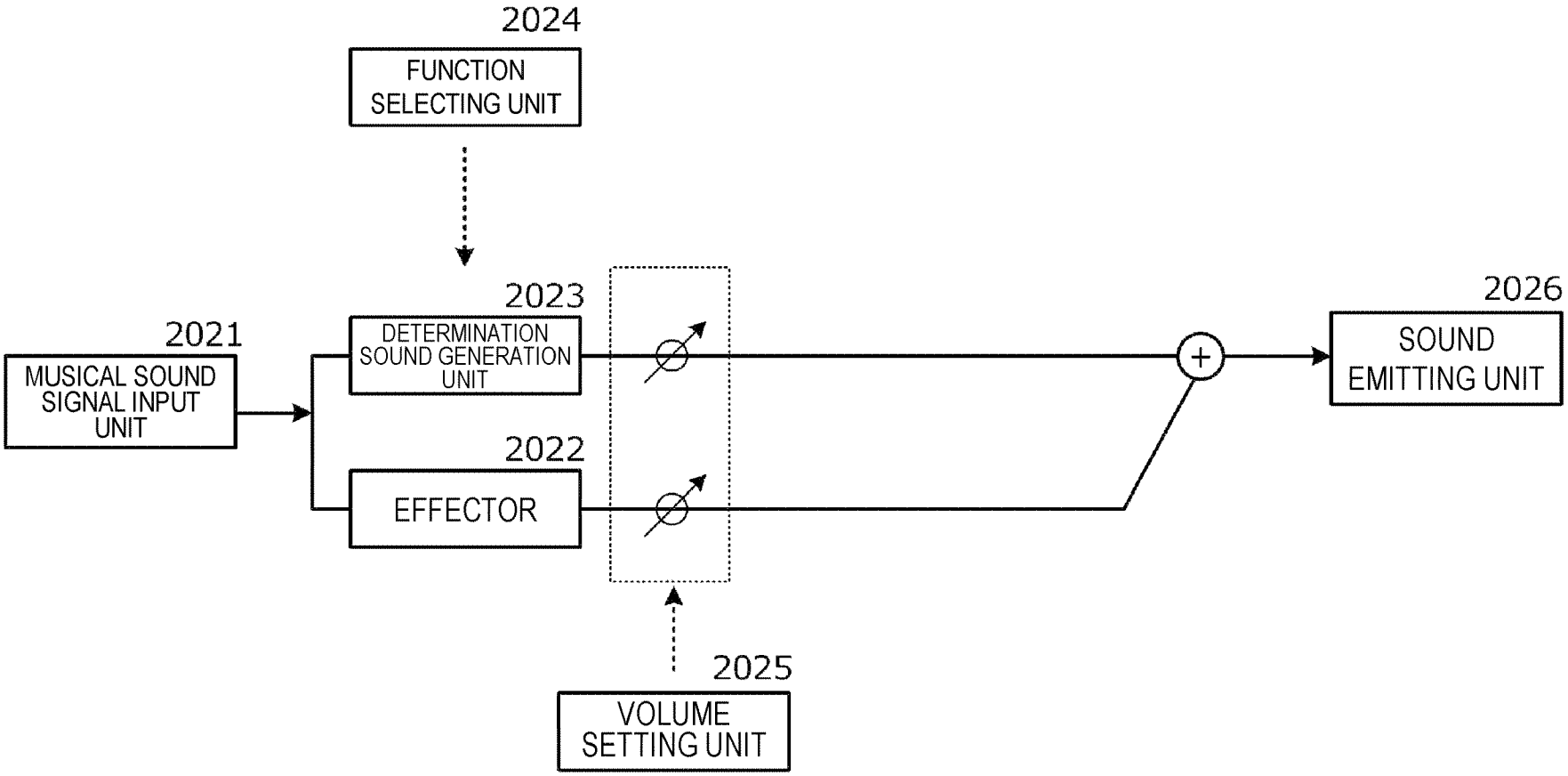
FIG. 5 is a functional configuration diagram of a DSP (Digital Signal Processor) of a sound output device according to a first embodiment.

Next, with reference to FIG. 5, a functional block of the DSP 202 will be described.

The DSP 202 is configured to include each of functional blocks such as a musical sound signal input unit 2021, an effector 2022, a determination sound generation unit 2023, a function selecting unit 2024, a volume setting unit 2025, and a sound emitting unit 2026. The functional blocks may be realized by the DSP 202 executing corresponding program modules.

The musical sound signal input unit 2021 acquires a musical sound signal received via the wireless reception unit 201 and decodes the musical sound signal. The decoded signal is input to the effector 2022 and the determination sound generation unit 2023. In the following description, a musical sound signal is used to refer to both of an analog signal and a digital signal.

The effector 2022 adds an effect to the input musical sound signal. The effector 2022 has a plurality of effect units built thereinto, and may add predetermined effects such as chorus, phaser, tremolo, and vibrato to the musical sound signal.

The determination sound generation unit 2023 performs tuning on the basis of the input musical sound signal. Specifically, a frequency (hereinafter, a reference frequency) for comparison is determined on the basis of the input musical sound signal, and a frequency of the musical sound signal is compared with the reference frequency. For example, in a case where it is recognized that the input musical sound signal corresponds to the scale of A4, it is determined that comparison will be performed by using a frequency of 440 Hz, and the two frequencies are compared. On the basis of a result of the comparison, a signal sound (hereinafter, a determination sound) indicating the result of the comparison is generated. In the present embodiment, there are the following three types of determination sounds.

(1) A determination sound indicating that the frequency of the musical sound signal is lower than the reference frequency (first determination sound)

(2) A determination sound indicating that the frequency of the musical sound signal is higher than the reference frequency (second determination sound)

(3) A determination sound indicating that the frequency of the musical sound signal is substantially the same as the reference frequency (third determination sound)

The function selecting unit 2024 switches between an active/inactive state of the determination sound generation unit 2023. The function selecting unit 2024 switches an active/inactive state of the determination sound generation unit 2023 on the basis of an operation performed by an operator by using a switch (not illustrated).

Here, in a case where the determination sound generation unit 2023 is brought into an active state, that is, a tuning function is selected to be validated, as described above, a determination sound (any of the first to third determination sounds) is generated by the determination sound generation unit 2023. The generated determination sound is mixed with a sound signal (hereinafter, an original sound) having passed through the effector 2022 and output.

On the other hand, in a case where the determination sound generation unit 2023 is brought into an inactive state, that is, the tuning function is selected to be invalidated, a process using the determination sound generation unit 2023 is not performed. In this case, only a sound signal (original sound) having passed through the effector 2022 is output.

The volume setting unit 2025 attenuates the sound signals output from the determination sound generation unit 2023 and the effector 2022 on the basis of the user's operation.

The sound emitting unit 2026 outputs the sound signal output from the effector 2022 and the sound signal output from the determination sound generation unit 2023. The output sound signals are emitted via the amplifier 205 and the speaker 206.

Next, a process performed by the determination sound generation unit 2023 will be described with reference to FIGS. 6 and 7.

Figure 6:
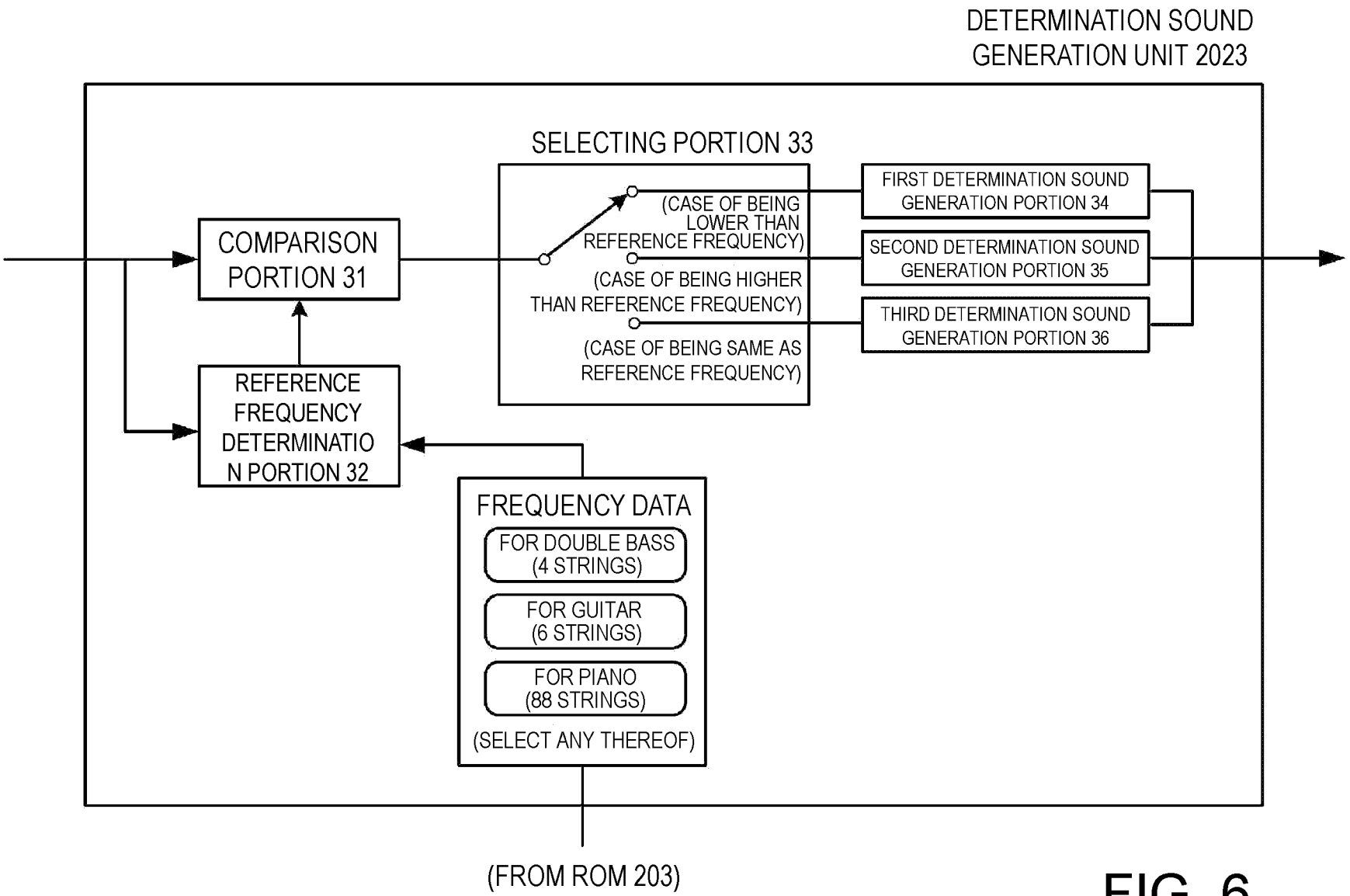
FIG. 6 is a functional configuration diagram of a determination sound generation unit.
Figure 7:
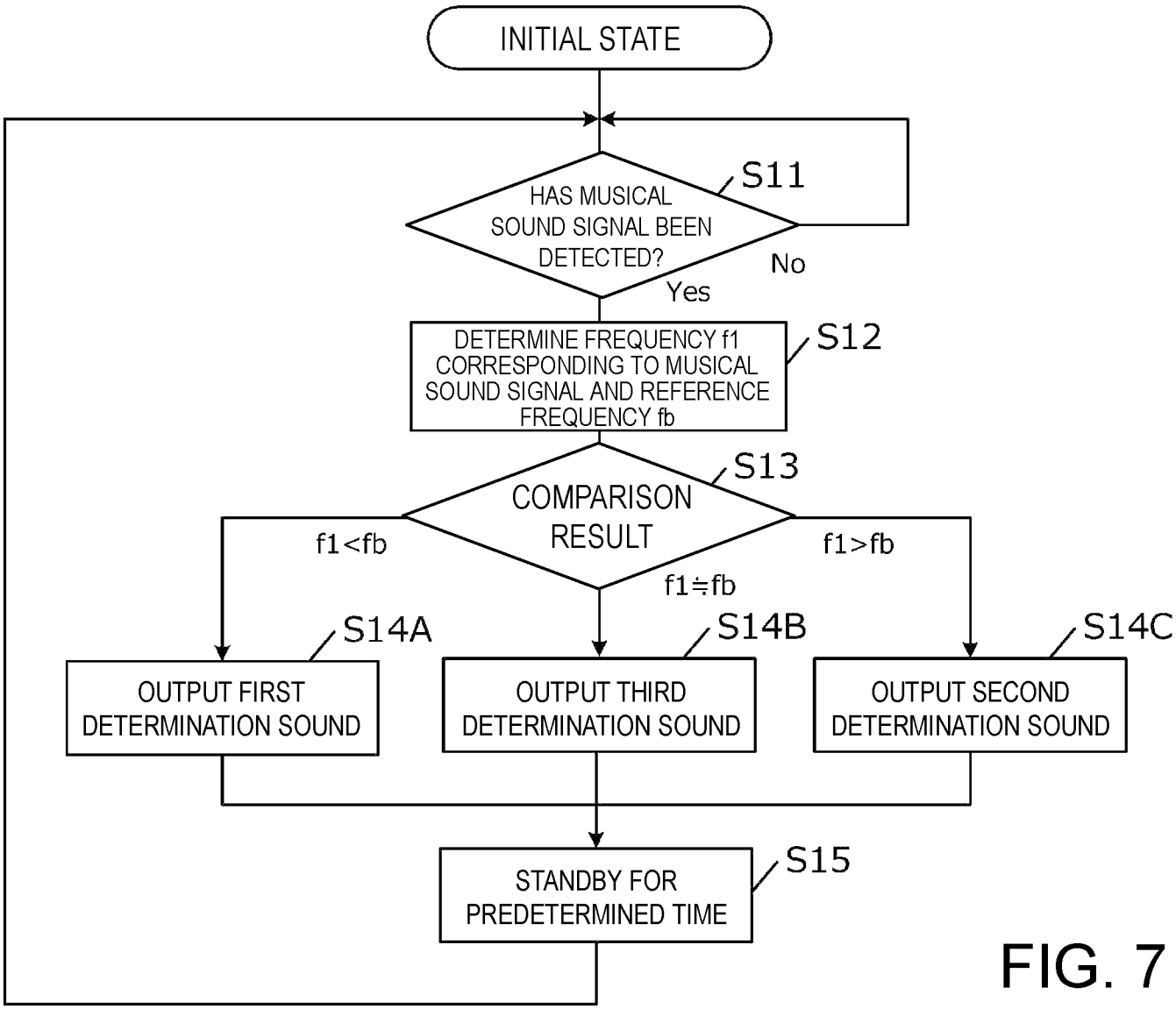
FIG. 7 is a flowchart illustrating a process performed by the sound output device.

FIG. 6 is a diagram for describing functional blocks of the determination sound generation unit 2023. FIG. 7 is a flowchart illustrating a process performed by the determination sound generation unit 2023 in an active state.

First, in step S11, it is determined whether or not a musical sound signal has been detected. Here, in a case where a determination result is negative (for example, in a case where a signal level is equal to or less than a predetermined value), the determination sound generation unit 2023 waits for a musical sound signal to be detected. In a case where a determination result is affirmative in step S11, the flow proceeds to step S12, and a frequency f1 corresponding to the musical sound signal and a reference frequency fb for comparison are determined.

In step S12, first, a reference frequency determination portion 32 estimates an original scale of the musical sound signal. For example, the musical sound signal is subjected to Fourier transform to extract frequency components, and the frequency f1 corresponding to the musical sound signal is specified on the basis of the extracted frequency components. In a case where there are frequency components of a plurality of peaks, a principal frequency may be specified according to a predetermined method.

Next, a pitch is estimated on the basis of the specified frequency. FIG. 8 illustrates an example of data (hereinafter, frequency data) for determining a reference frequency by using a frequency corresponding to a musical sound signal. A pitch closest to the musical sound signal can be estimated by referring to the frequency data as illustrated.

The reference frequency fb corresponding to the estimated pitch is determined. For example, in a case where the estimated pitch is A4, 440 Hz is selected as the reference frequency.

The frequency data illustrated in FIG. 8 may be stored in advance in the ROM 203.

In the example in FIG. 8, the scale is set to one octave, but the frequency data is not limited to this. For example, in a case where a tuning target is a piano, frequency data in which pitches and frequencies corresponding to 88 strings are associated with each other may be used. In a case where a tuning target is a double bass, frequency data in which pitches and frequencies corresponding to four strings are associated with each other may be used. In a case where a tuning target is a guitar, frequency data in which pitches and frequencies corresponding to six strings are associated with each other may be used.

A plurality of pieces of frequency data may be stored. In a case where a plurality of pieces of frequency data are used, the reference frequency determination portion 32 may select frequency data to be used on the basis of an instruction from the operator. A connected musical instrument may be automatically determined, and frequency data to be used may then be selected.

Next, a comparison portion 31 compares the frequency of the musical sound signal with the reference frequency, and classifies a comparison result into three patterns such as "lower", "substantially the same", and "higher" (step S13). Substantially the same range may be set to a design value, but is preferably set to a range in which tuning is considered to be musically established.

In a case where the frequency of the musical sound signal is lower than the reference frequency (or a predetermined range set on the basis of the reference frequency), the flow proceeds to step S14A such that the first determination sound is generated and output. In step S14A, a selecting portion 33 selects a first determination sound generation portion 34, and the first determination sound generation portion 34 generates the first determination sound.

In a case where the frequency of the musical sound signal is higher than the reference frequency (or a predetermined range set on the basis of the reference frequency), the flow proceeds to step S14C such that the second determination sound is generated and output. In step S14C, the selecting portion 33 selects a second determination sound generation portion 35, and the second determination sound generation portion 35 generates the second determination sound.

In a case where the frequency of the musical sound signal is substantially the same as the reference frequency (or within a predetermined range set on the basis of the reference frequency), the flow proceeds to step S14B such that the third determination sound is generated and output. In step S14B, the selecting portion 33 selects a third determination sound generation portion 36, and the third determination sound generation portion 36 generates the third determination sound.

In step S15, standby is performed for a predetermined time, and then the flow proceeds to step S11. Consequently, a determination sound can be intermittently output.

Here, a determination sound will be described.

The first determination sound is preferably a sound from which it can be intuitively understood that a frequency of a currently emitted sound is lower than the reference frequency. For example, two types of beep sounds having different pitches in the order of low to high are output, and thus it is possible to transfer to the operator that a pitch is to be raised.

The second determination sound is preferably a sound from which it can be intuitively understood that a frequency of a currently emitted sound is higher than the reference frequency. For example, two types of beep sounds having different pitches in the order of high to low are output, and thus it is possible to transfer to the operator that a pitch is to be lowered.

(An example of the first determination sound) popi . . . popi . . . popi . . . (po represents a low pitch, and pi represents a high pitch)

(An example of the second determination sound) pipo . . . pipo . . . pipo . . . (same)

A combination of pitches of the determination sounds is not limited to the examples.

The determination sound does not have to be a combination of independent beep sounds. For example, a sound (sweep sound) of which a pitch changes continuously is output, and thus it is possible to transfer a direction in which adjustment is to be performed (whether the pitch is to be adjusted to be raised or lowered). The pitch of the sweep sound changes in proportion to time, but a rate of change is not limited to a linear function. For example, the pitch may change exponentially with time, such as an exponential chirp. According to such a configuration, it is possible to give the operator the impression that the pitch goes up and down linearly.

The third determination sound is preferably a sound from which it can be intuitively understood that a frequency of a currently emitted sound is substantially the same as the reference frequency. For example, a beep sound of which a pitch does not change is output, and thus it is possible to transfer to the operator that tuning has been completed.

(An example of the third determination sound) pipi . . . pipi . . . pipi . . . .

In the above-described example, an emission interval (first cycle) of a determination sound is changed with the predetermined time in step S15.

As described above, the tuning device according to the present embodiment outputs different determination sounds on the basis of a result of comparing a frequency of a musical sound signal acquired from a musical instrument with the reference frequency. According to such an aspect, it is possible to intuitively understand a direction in which adjustment is to be performed (whether a pitch is to be adjusted to be raised or lowered).

Since a musical sound signal that has passed through the effector and a determination sound are mixed and output, it is possible to perform tuning while hearing actually obtained performance sounds.

The tuning device according to the present embodiment can be suitably applied to tuning of a musical instrument of which a pitch can be continuously adjusted according to, for example, an amount of operation. For example, when tuning a stringed instrument such as a guitar, a double bass, or a piano, particularly an instrument having pegs for adjusting tension of strings, it is preferable to observe states of the pegs or the strings one by one during work, but in a case where information is given visually as in the related art, an operator cannot concentrate on a state of the instrument. On the other hand, the tuning device according to the present embodiment can report a status only by sound, and thus an operator can concentrate on work.

Second Embodiment

A second embodiment is an embodiment in which the predetermined time in step S15 is variable. A hardware configuration of the sound output device 20 according to the second embodiment is the same as that in the first embodiment except processes executed by the determination sound generation unit 2023.

In the second embodiment, the determination sound generation unit 2023 determines the predetermined time in step S15, that is, a sound emission interval of a determination sound on the basis of a "deviation width between a frequency of a musical sound signal and the reference frequency".

Figure 9:
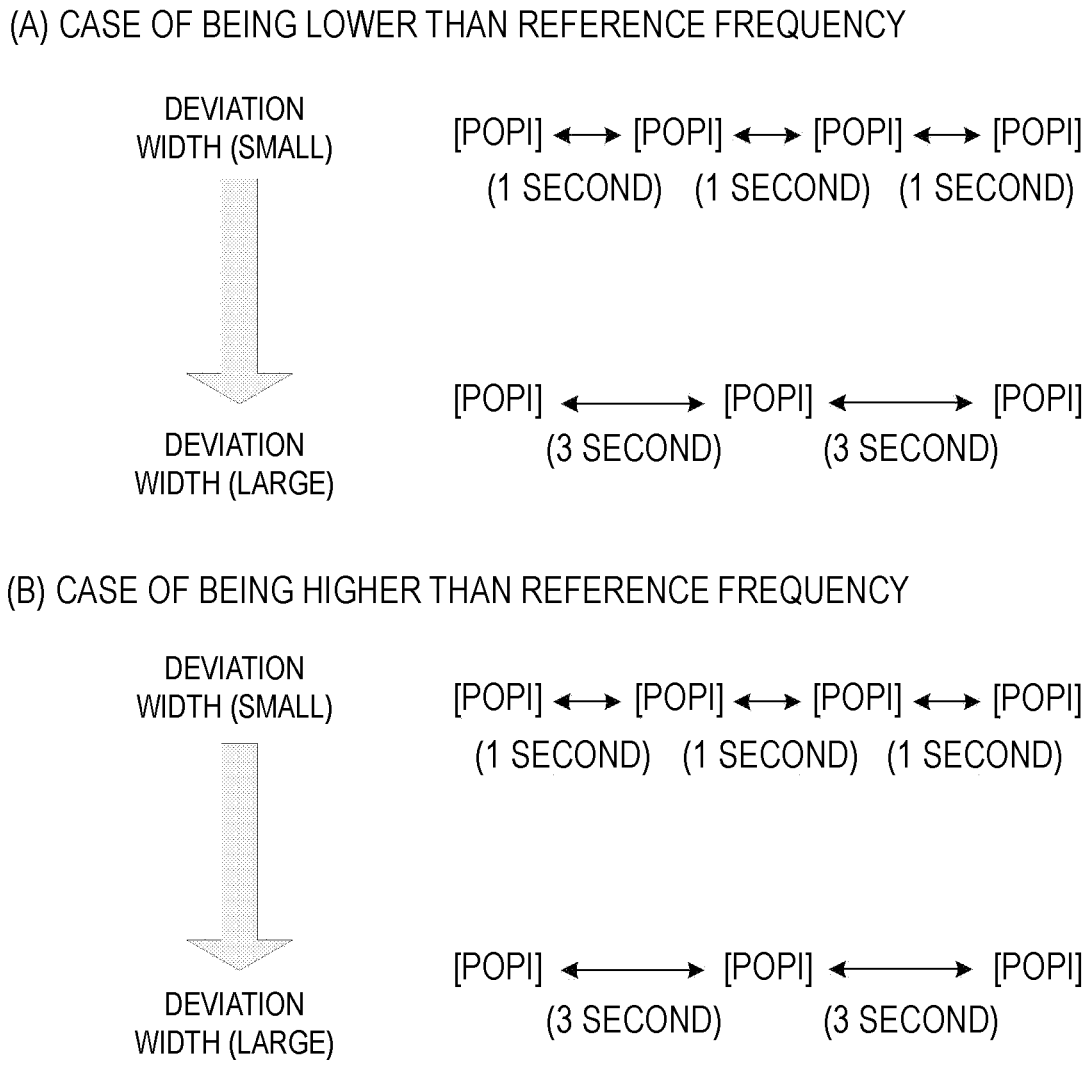
FIG. 9 is a diagram for describing a relationship between a deviation width and a sound emission interval.
Figure 10:
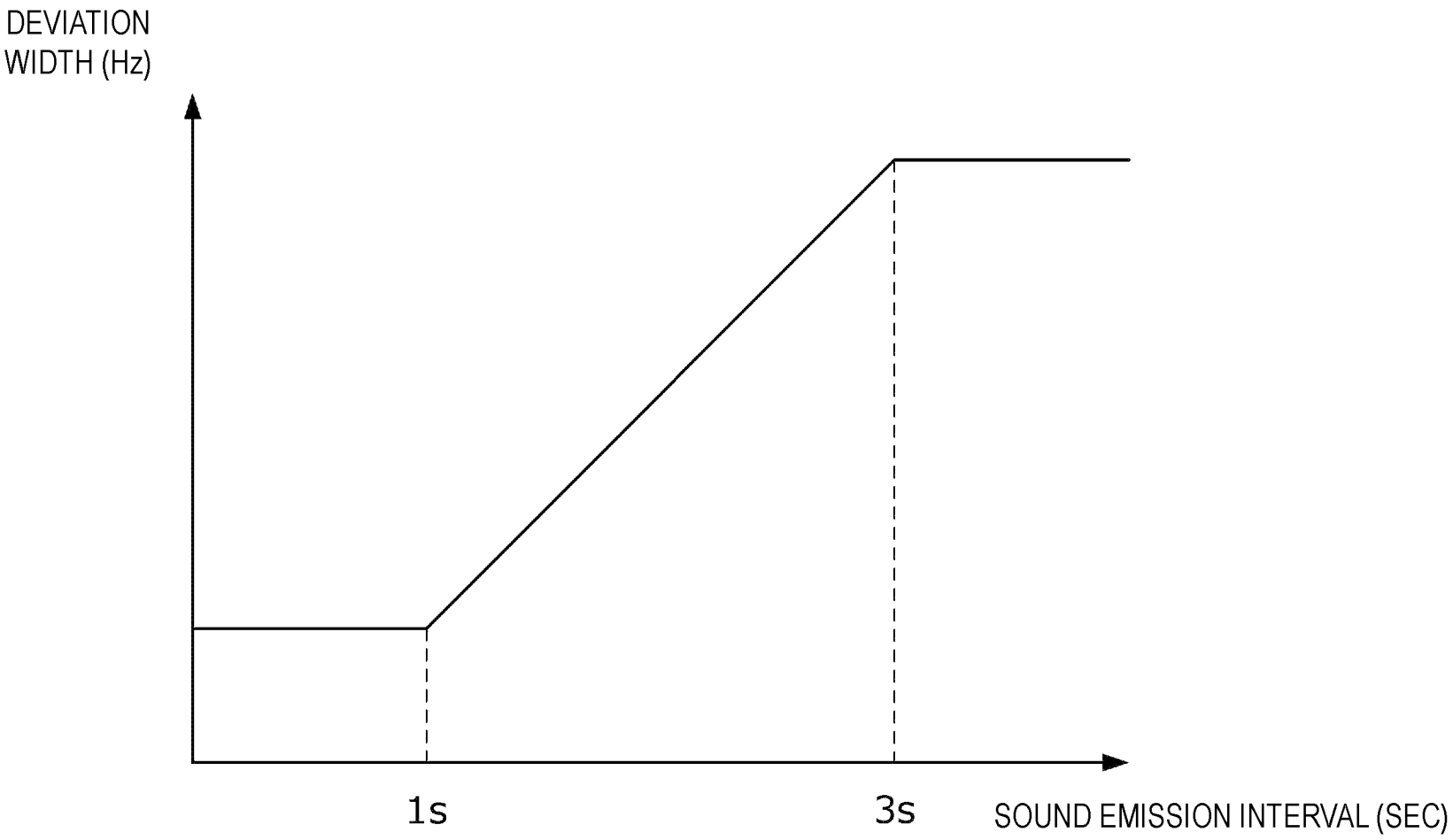
FIG. 10 is a diagram for describing a relationship between a deviation width and a sound emission interval.

FIG. 9 is a diagram for describing a sound emission interval of a determination sound. In the present embodiment, in a case where a difference (deviation width) between the frequency of the musical sound signal and the reference frequency is large, control is performed such that a sound emission interval becomes longer. A relationship between the deviation width and the sound emission interval can be defined as illustrated in FIG. 10, for example. Such data may be stored in the ROM 203 in advance.

According to the second embodiment, an operator can be notified by sound of the magnitude of a difference between a frequency of a musical sound signal and the reference frequency. Consequently, the operator can easily understand a width to be adjusted.

In the present embodiment, control is performed such that a sound emission interval becomes longer as a deviation width becomes larger, but the control may be performed such that the sound emission interval becomes shorter as the deviation width becomes larger. That is, the sound emission interval may be correlated with a difference between the frequency of the musical sound signal and the reference frequency.

Third Embodiment

Figure 11:
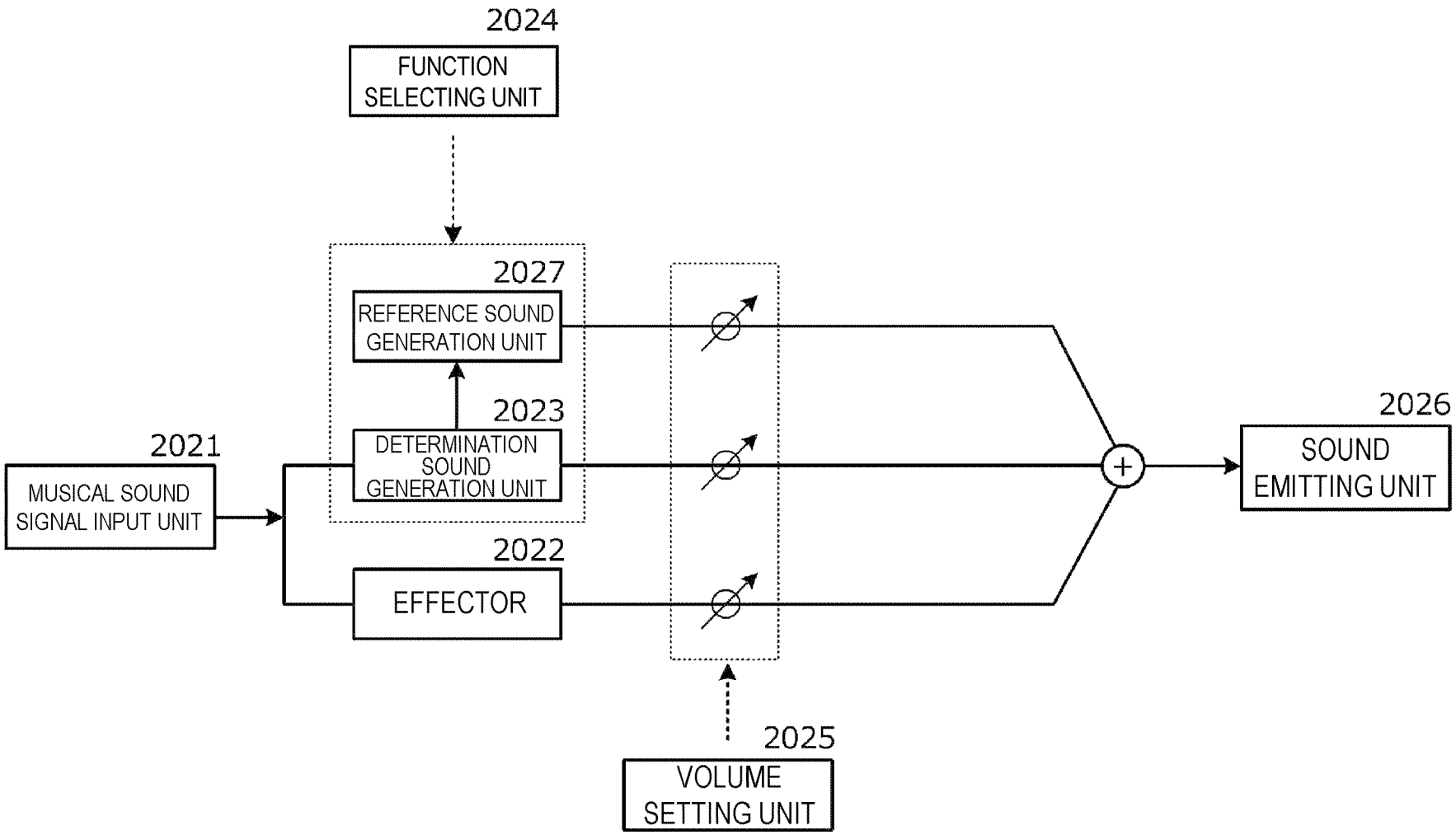
FIG. 11 is a functional configuration diagram of a DSP of a sound output device according to a third embodiment.

A third embodiment is an embodiment in which a sound signal indicating a reference frequency is output in addition to a determination sound. FIG. 11 is a functional block diagram of the sound output device 20 (DSP 202) according to the third embodiment.

In the third embodiment, the DSP 202 is configured to further include a reference sound generation unit 2027. The reference sound generation unit 2027 generates a sound signal (hereinafter, a reference sound; for example, a sine wave) corresponding to a reference frequency determined by the determination sound generation unit 2023. The reference sound is mixed with a determination sound and an original sound to be output via the sound emitting unit 2026.

In the third embodiment, the function selecting unit 2024 is configured such that an active state of the determination sound generation unit 2023 and an active state of the reference sound generation unit 2027 are switched simultaneously or separately. For example, selection may be made such as "only the determination sound generation unit 2023 is in an active state" and "the determination sound generation unit 2023 and the reference sound generation unit 2027 are in an active state".

According to the third embodiment, since an operator can hear an original sound and a reference sound at the same time, it becomes easier to understand a direction in which adjustment is to be performed.

Modification Examples

The embodiments are only examples, and the present invention may be modified and implemented as appropriate without departing from the spirit thereof. For example, the respective embodiments may be combined and implemented.

In the description of the embodiments, the sound output device 20 connected in a wireless manner has been described, but the tuning device according to the present invention may be a device connected in a wired manner.

A tuning target does not necessarily have to be an electronic musical instrument, and may be any musical instrument as long as the musical instrument outputs an audio signal.

In the description of the embodiments, standby is performed for the predetermined time in step S15, but in a case where new rising (attack) of a musical sound signal is detected during the standby, the standby may be interrupted and the determination in step S13 may be started immediately. A rising timing of the musical sound signal may be, for example, a timing at which a level of the musical sound signal exceeds a predetermined value.

According to such a configuration, in a case where an operator hits a key or performs picking, a determination sound is immediately output, and thus a deviation width can be reported more quickly and intuitively.

REFERENCE SIGNS LIST

10 Transmitter
20 Sound output device
30 Electronic guitar
101 CPU
102, 203 ROM
103, 204 RAM
104 Connection unit
105 Wireless transmission unit
201 Wireless reception unit
202 DSP
205 Amplifier
206 Speaker

What is claimed is:

1. A tuning device comprising:

a signal acquisition means for acquiring an audio signal;

a comparison means for comparing a frequency of the audio signal with a reference frequency corresponding to the audio signal; and a generation means for generating a first sound signal in a case where the frequency of the audio signal is lower than the reference frequency and generating a second sound signal different from the first sound signal in a case where the frequency of the audio signal is higher than the reference frequency, wherein the first and second sound signals are sound signals generated in a first cycle, and wherein the first cycle is a value correlated with a difference between the frequency of the audio signal and the reference frequency, wherein, in a case where the signal acquisition means has detected rising of the audio signal, the generation means resets counting of the first cycle and immediately starts to generate the first sound signal or the second sound signal.

2. The tuning device according to claim 1, wherein the first and second sound signals are a combination of two or more sounds having different pitches, and wherein the pitches have opposite combinations in the first sound signal and the second sound signal.

3. The tuning device according to claim 2, wherein the first and second sound signals are sweep sounds in which two or more sounds having different pitches are continuously connected to each other.

4. The tuning device according to claim 1, wherein, in a case where the frequency of the audio signal is substantially the same as the reference frequency, the generation means generates a third sound signal different from the first and second sound signals.

5. The tuning device according to claim 1, further comprising:

an effect adding means for adding a predetermined effect to the audio signal, wherein the generation means mixes the audio signal to which an effect has been added with the first sound signal or the second sound signal.

6. A tuning device comprising:

a signal acquisition means for acquiring an audio signal;

a comparison means for comparing a frequency of the audio signal with a reference frequency corresponding to the audio signal; and a generation means for generating a sound signal in a first cycle in a case where the frequency of the audio signal is not substantially the same as the reference frequency, wherein the first cycle is a value correlated with a difference between the frequency of the audio signal and the reference frequency;

wherein the generation means generates a first sound signal in a case where the frequency of the audio signal is lower than the reference frequency and generates a second sound signal different from the first sound signal in a case where the frequency of the audio signal is higher than the reference frequency, wherein the first and second sound signals are a combination of two or more sounds having different pitches, and wherein the pitches have opposite combinations in the first sound signal and the second sound signal.

7. The tuning device according to claim 6, wherein the first and second sound signals are sweep sounds in which two or more sounds having different pitches are continuously connected to each other.

8. The tuning device according to claim 6, wherein, in a case where the signal acquisition means has detected rising of the audio signal, the generation means resets counting of the first cycle and immediately starts to generate the first sound signal or the second sound signal.

9. The tuning device according to claim 6, wherein, in a case where the frequency of the audio signal is substantially the same as the reference frequency, the generation means generates a third sound signal different from the first and second sound signals.

10. The tuning device according to claim 6, further comprising:

an effect adding means for adding a predetermined effect to the audio signal, wherein the generation means mixes the audio signal to which an effect has been added with the first sound signal or the second sound signal.

11. The tuning device according to claim 1, wherein the signal acquisition means acquires the audio signal from a musical instrument that is capable of continuously adjusting a pitch according to an amount of tuning operation.

12. A tuning method comprising:

acquiring an audio signal of a tuning target ;

comparing a frequency of the audio signal with a reference frequency corresponding to the audio signal; and generating a sound signal in a first cycle in a case where the frequency of the audio signal is not substantially the same as the reference frequency, wherein the first cycle is a value correlated with a difference between the frequency of the audio signal and the reference frequency, wherein the generating of the sound signal comprising generating a first sound signal in a case where the frequency of the audio signal is lower than the reference frequency and generating a second sound signal different from the first sound signal in a case where the frequency of the audio signal is higher than the reference frequency, wherein the first and second sound signals are a combination of two or more sounds having different pitches, and wherein the pitches have opposite combinations in the first sound signal and the second sound signal.

13. The tuning method according to claim 12, wherein the first and second sound signals are sweep sounds in which two or more sounds having different pitches are continuously connected to each other.

14. The tuning method according to claim 12, in a case where the acquired audio signal rises, resetting counting of the first cycle and immediately starts to generate the first sound signal or the second sound signal.

* * * * *